US006457411B2

(12) United States Patent
Yoshizawa et al.

(10) Patent No.: US 6,457,411 B2
(45) Date of Patent: Oct. 1, 2002

(54) BLANKET CYLINDER PROVIDING FOR READY MOUNTING AND DISMOUNTING OF A BLANKET

(75) Inventors: Kohji Yoshizawa, Kanagawa (JP); Mutsuhito Yoneta, Tokyo (JP); Tadashi Hachiya, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/877,032

(22) Filed: Jun. 11, 2001

(30) Foreign Application Priority Data

Jul. 12, 2000 (JP) ..... 2000-210987

(51) Int. Cl.[7] ..... B41F 27/12
(52) U.S. Cl. ..... 101/415.1; 101/217; 101/378
(58) Field of Search ..... 101/415.1, 217, 101/378, 382.1, 383, 375; 428/909

(56) References Cited

U.S. PATENT DOCUMENTS

| | | | | | |
|---|---|---|---|---|---|
| 3,008,410 | A | * | 11/1961 | Bryer | 101/415.1 |
| 3,016,010 | A | * | 1/1962 | Luehrs | 101/415.1 |
| 4,702,166 | A | | 10/1987 | Depa | 101/415.1 |
| 5,131,327 | A | * | 7/1992 | Nagasono et al. | 101/415.1 |
| 5,454,316 | A | | 10/1995 | Ohta et al. | 101/415.1 |
| 5,644,984 | A | * | 7/1997 | Puschnerat et al. | 101/409 |
| 6,231,490 | B1 | * | 5/2001 | Speil et al. | 101/378 |
| 2002/0005131 | A1 | * | 1/2002 | Yoshizawa et al. | 101/415.1 |
| 2002/0078846 | A1 | * | 6/2002 | Reichel et al. | 101/415.1 |

FOREIGN PATENT DOCUMENTS

| | | |
|---|---|---|
| DE | 195 41 249 A1 | 11/1996 |
| DE | 298 02 211 U1 | 5/1998 |
| EP | 0 418 991 A2 | 3/1991 |
| EP | 0 844 082 A2 | 5/1998 |
| FR | 2 341 434 | 9/1977 |
| JP | 9-99543 | 4/1997 |
| JP | 2746839 | 2/1998 |

* cited by examiner

*Primary Examiner*—Leslie J. Evanisko
(74) *Attorney, Agent, or Firm*—Rader, Fishman & Grauer, PLLC

(57) ABSTRACT

A blanket cylinder used in offset lithography includes a cylinder body, a retainer spindle and a resilient member. The cylinder body has an undercut groove with a first undercut longitudinal edge for engaging a first flange of a carrier sheet and a second undercut longitudinal edge for temporarily engaging a rim of the carrier sheet. The retainer spindle is received in the undercut groove for bi-directional rotation. The retainer spindle includes a pull-in hook that engages the rim of the carrier sheet to pull a second end portion thereof into the undercut groove with rotation of the retainer spindle in a first direction and a push-out ledge abuts against the rim of the carrier sheet in order to push a second end portion thereof out of the undercut groove with rotation of the retainer spindle in a second direction. The resilient member energizes the retainer spindle in the first direction.

10 Claims, 6 Drawing Sheets

BLANKET CYLINDER PROVIDING FOR READY MOUNTING AND DISMOUNTING OF A BLANKET

BACKGROUND OF THE INVENTION

This invention relates to printing presses, to web-fed offset printing presses, and, more specifically, to a blanket cylinder for use in such presses. Still more specifically, the invention deals with improvements in or relating to such a blanket cylinder designed for easy, firm mounting of a blanket around the same as well as for ready dismounting of the blanket therefrom.

In web-fed offset lithography, as is well known, a printing plate on a plate cylinder prints the inked image on the surface of a blanket of rubber or like material fastened to a blanket cylinder. The printed image is then offset or transferred from the blanket to the web running against an impression cylinder or, in offset perfecting presses, against another blanket cylinder.

A variety of blanket cylinders have been devised and used which are designed for easy mounting and dismounting of blankets. Out of such prior art devices, two are considered pertinent to the instant invention. One of these, disclosed in Japanese Unexamined Patent Publication No. 9-99543, teaches to create in a blanket cylinder an undercut groove extending parallel to the cylinder axis. Rotatably mounted in the undercut groove is a spring-loaded spindle having a series of pusher lugs aligned longitudinally thereof at constant spacings. The spindle is driven between a working position, in which the pusher lugs are oriented normal to the wall surface of the undercut groove, and a retracted position in which the lugs are turned away from the groove wall.

The rubber blanket for use with this prior art blanket cylinder is bonded to a sheet-metal carrier of rectangular shape. The blanket carrier has a pair of opposite end portions, extending beyond the edges of the blanket, that are bent respectively into an acute and an obtuse angle whose sum is approximately 180 degrees.

For mounting the blanket to the blanket cylinder, the acute-angled end portion of the blanket carrier is first hooked onto one of the pair of longitudinal edges of the entrance opening of the undercut groove; then the blanket with the carrier is wound around the cylinder by turning the latter; and then the obtuse-angled end portion of the blanket carrier is inserted in the undercut groove. The pair of opposite end portions of the blanket carrier, bent complementarily, are now held against each other in the undercut groove. Then the spring-loaded spindle is revolved from the retracted to the working position, with the result that the pusher lugs thereon are turned into abutment against the superposed end portions of the blanket carrier, until, with the blanket tightened against the cylinder, the pusher lugs become approximately perpendicular to the carrier end portions, pushing them against the groove wall and so frictionally retaining them against displacement during printing. The spindle is to be turned back to the retracted position for dismounting the blanket.

An objection to this prior art blanket cylinder is the frictional engagement of the blanket carrier end portions by the pusher lugs on the spindle. During printing, of course, the blanket cylinder rotates in rolling engagement with the plate cylinder and, via the web of paper, with the impression cylinder or, in the case of an offset perfecting press, with the blanket cylinder on the other side of the web. The blanket tends to slacken and get loose on the blanket cylinder by reasons of its direct or indirect contact with the other cylinders. The prior art blanket cylinder is totally unequipped to take up the possible slack.

Japanese Patent No. 2,746,839 defeats the noted shortcoming of the first described prior art device, suggesting a blanket cylinder also having a groove cut in its surface so as to extend parallel to the cylinder axis. Rotatably received in this groove, a blanket-tightening spindle is toothed for mating engagement with racks each extending at right angles with the spindle axis and all arranged at spacings axially of the spindle. The racks are sprung, biasing the spindle to turn in a predetermined blanket-tightening direction.

The blanket for use with the second recited known blanket cylinder has a pair of metal-made mounting fixtures on its opposite ends. One of the fixtures is hooked onto one of the jaws bounding the longitudinal edges of the groove in the blanket cylinder. Then, after wrapping the blanket around the cylinder, the other fixture is inserted in the cylinder groove and further in a groove in the tightening spindle. Then the racks are driven by the springs to revolve the spindle in the tightening direction, until the blanket is held fast against the cylinder surface.

It is a definite advantage of this second known blanket cylinder that the blanket thereon is not to develop a slack during printing, because then the springs continue to energize the spindle in the blanket-tightening direction. This advantage is offset, however, by some inherent drawbacks.

First, the second prior art device requires an inconveniently wide groove in the blanket cylinder, wide enough to receive both ends of the blanket together with the mounting fixtures thereon. More precisely, the groove must be wider than the sum of twice the blanket thickness and the total thickness of the fixtures on its opposite ends. Considerable vibration and noise has therefore been generated when, during printing, the meeting ends of the blanket on the blanket cylinder come into direct forced engagement with the meeting ends of the printing plate on the plate cylinder or, via the web, with those of the other blanket on the other blanket cylinder. A reduction of mechanical vibration and noise is of utmost importance as printing presses today are designed to run faster and faster.

Another drawback concerns the complexity of the means for biasing the blanket-tightening spindle in one direction of rotation, such means comprising sets of gear teeth formed on the spindle, racks engaged with the teeth, and compression springs acting on the racks. Additionally, an air conduit together with a source of air under pressure is needed for loosening the blanket by turning the spindle in the opposite direction against the forces of the compression springs.

SUMMARY OF THE INVENTION

It is therefore an object of this invention to provide a blanket cylinder so made that the blanket mounted thereto is to stay closely wrapped around the same against the risk of slacking during printing, assuring the production of high quality printings.

Another object of the invention is to attain the first recited object by creating in the blanket cylinder an undercut groove having an entrance slot of materially less width, with a view to the reduction of noise and vibration conventionally generated by reason of an inconveniently wide entrance slot.

Another object of the invention is to make the means for pulling the blanket, as the same is mounted to the blanket cylinder, so as to hold the blanket tightly around the blanket cylinder, far simpler and less expensive than heretofore.

A further object of the invention is to expedite the mounting and dismounting of the blanket to and from the blanket cylinder.

In summary, the present invention concerns an improved blanket cylinder for use in offset lithography, in combination with a blanket assembly which includes a blanket and a carrier sheet therefor. The carrier sheet of the blanket assembly has a major portion to which the blanket is attached, a first end portion bent at an angle to the major portion to provide a first flange, and a second end portion bent twofold to provide a second flange at an angle to the major portion, and a rim at an angle to the second flange.

The blanket cylinder comprises a cylinder having formed therein an undercut groove extending parallel to the axis of the cylinder. The undercut groove has an entrance slot bounded by and between a first longitudinal edge which is cross-sectinally shaped to be positively engaged by the first flange of the carrier sheet in mounting the blanket assembly to the cylinder, and a second longitudinal edge which is cross-sectionally shaped to be temporarily engaged by the rim of the carrier sheet preparatory to insertion of the second flange thereof into the undercut groove. Received in the undercut groove for bidirectional rotation therein, a retainer spindle is cross-sectinally shaped to include a hook for engaging the rim of the carrier sheet in order to pull the second end portion thereof into the undercut groove with the rotation of the retainer spindle in a first direction, and a ledge, circumferentially spaced from and opposed to the hook, for abutment against the rim of the carrier sheet in order to push the second end portion thereof out the undercut groove with the rotation of the retainer spindle in a second direction opposite to the first. Also included is a resilient means for energizing the retainer spindle in the first direction relative to the cylinder in order to hold the blanket assembly fast against the cylinder. Such being the improved construction of the blanket cylinder according to the invention, it is only the opposite end portions of the carrier sheet that are inserted in the undercut groove for mounting the blanket assembly to the blanket cylinder. The entrance slot of the undercut groove can therefore be as narrow as only somewhat more than twice the thickness of the carrier sheet, resulting in appreciable curtailment of the vibration and noise generated upon forced meeting of the slot with the slots of the neighboring cylinders in a web-fed offset printing press.

Upon completion of being mounted to the blanket cylinder, the blanket assembly has its first flange held hooked onto the first longitudinal edge of the entrance slot. The second flange of the blanket assembly is also received wholly in the undercut groove as the rim of the second flange, engaged by the hook of the retainer spindle, is thereby pulled into the groove under the force of the resilient means. The blanket assembly is thus to stay tightly wrapped around the blanket cylinder against the risk of slacking even when placed in forced rolling contact with the plate cylinder and, via the web, with the impression cylinder or another blanket cylinder, during printing.

In one embodiment of the invention, the resilient means biasing the retainer spindle in the blanket-tightening direction takes the form of a pair of torsion springs coiled around the opposite end portions of the retainer spindle. The retainer spindle with such resilient means can be compactly and inexpensively built into the blanket cylinder.

The dismounting of the blanket assembly from the blanket cylinder is just as easy as its mounting. The blanket assembly will come loose on the cylinder simply as the retainer spindle is turned against the bias of the resilient torsion springs, as then the ledge of the spindle will push the rim of the carrier sheet toward the entrance slot of the groove.

In order to expedite such dismounting of the blanket assembly without making the blanket cylinder any more complex in construction, the retainer spindle has a pair of aligned extensions of hexagonal cross section projecting from the opposite ends of the blanket cylinder. Either extension of the spindle may be manually turned by a wrench or spanner, readily available in any printing plant, against the forces of the torsion springs. The above and other objects, features and advantages of the invention and the manner of realizing them will become more apparent, and the invention itself will best be understood, from the following description taken together with the attached drawings showing the preferred embodiments of the invention.

DESCRIPTION OF THE PREFERRED EMBODIMENT

General

Figure 1:
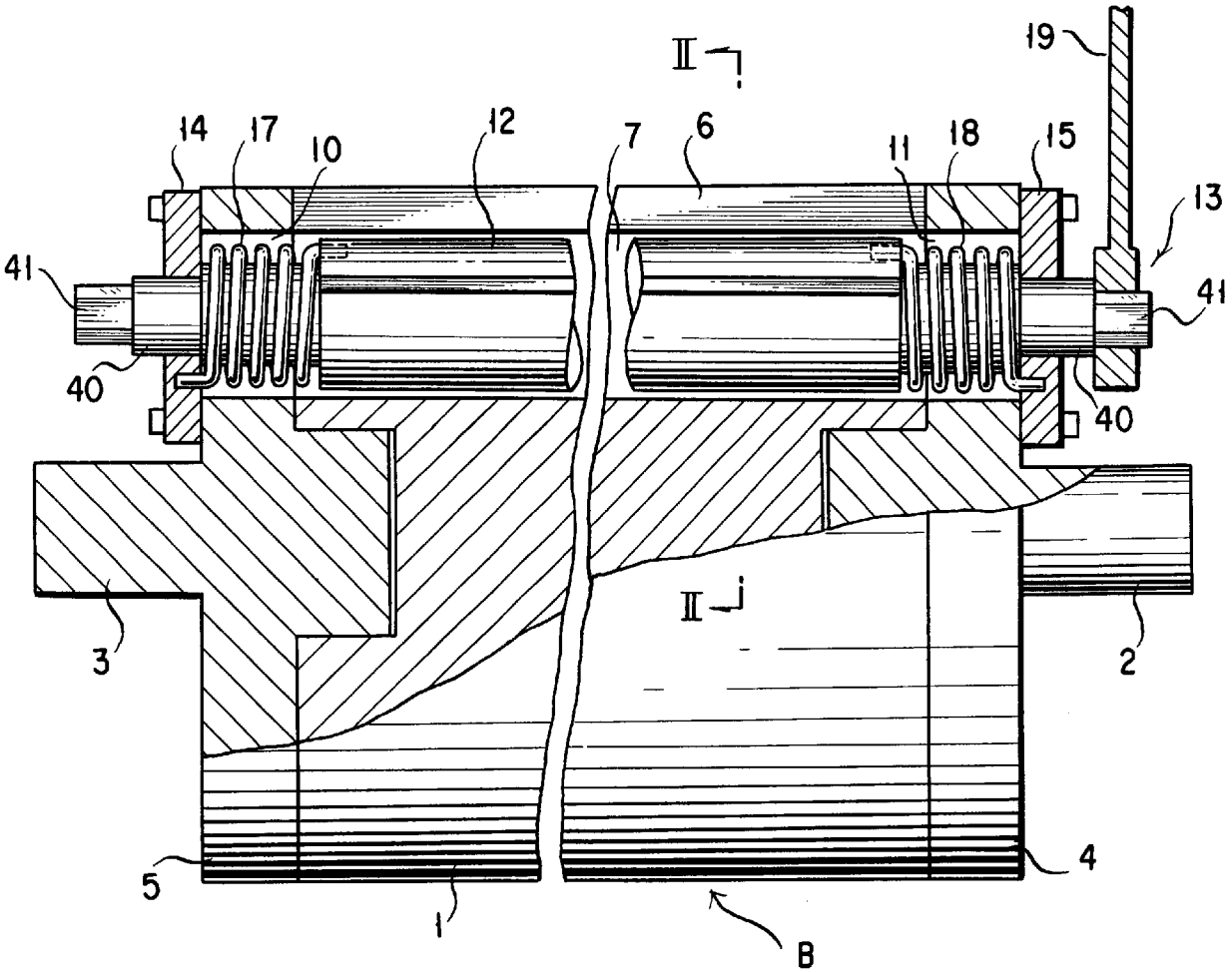
FIG. 1 is a side elevation of an example of blanket cylinder constructed in accordance with the present invention, the cylinder being shown partly broken away and partly shown in axial section to reveal, in particular, the undercut groove and the blanket retainer spindle received therein.
Figure 2:
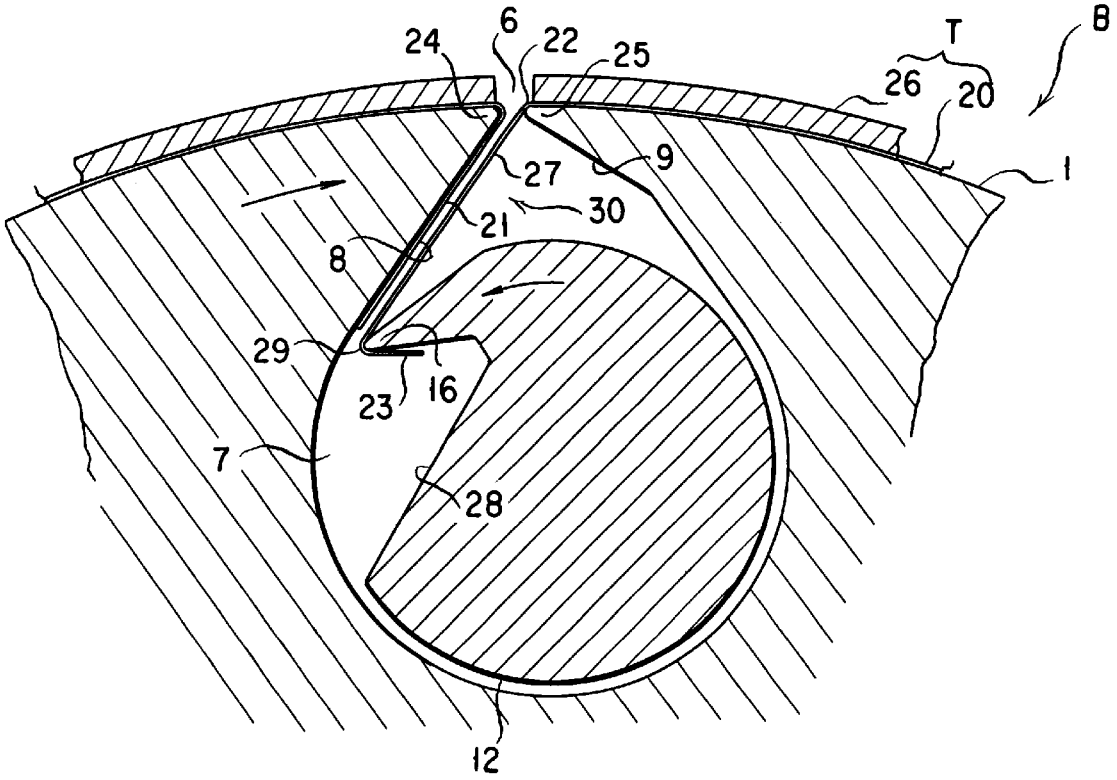
FIG. 2 is an enlarged, fragmentary cross section through the blanket cylinder, taken along the line II—II in FIG. 1, the view showing in particular how a blanket assembly has its opposite ends received in the undercut groove in the blanket cylinder, and one of them engaged by the retainer spindle.

In web-fed offset printing presses in general, the blanket cylinder and the plate cylinder are so angularly correlated to each other that the pair of meeting ends of a blanket on the blanket cylinder come into contact with the pair of meeting ends of a printing plate on the plate cylinder. Likewise, in an offset perfecting press having a pair of blanket cylinders for concurrently printing on both sides of the web, the pair of meeting ends of the blanket on one cylinder come into contact, via the web, with the pair of meeting ends of the blanket on the other cylinder. FIGS. 1 and 2 illustrate how each such blanket cylinder is constructed to retain the pair of meeting ends of a blanket in position thereon according to the novel concepts of this invention.

Figure 3:
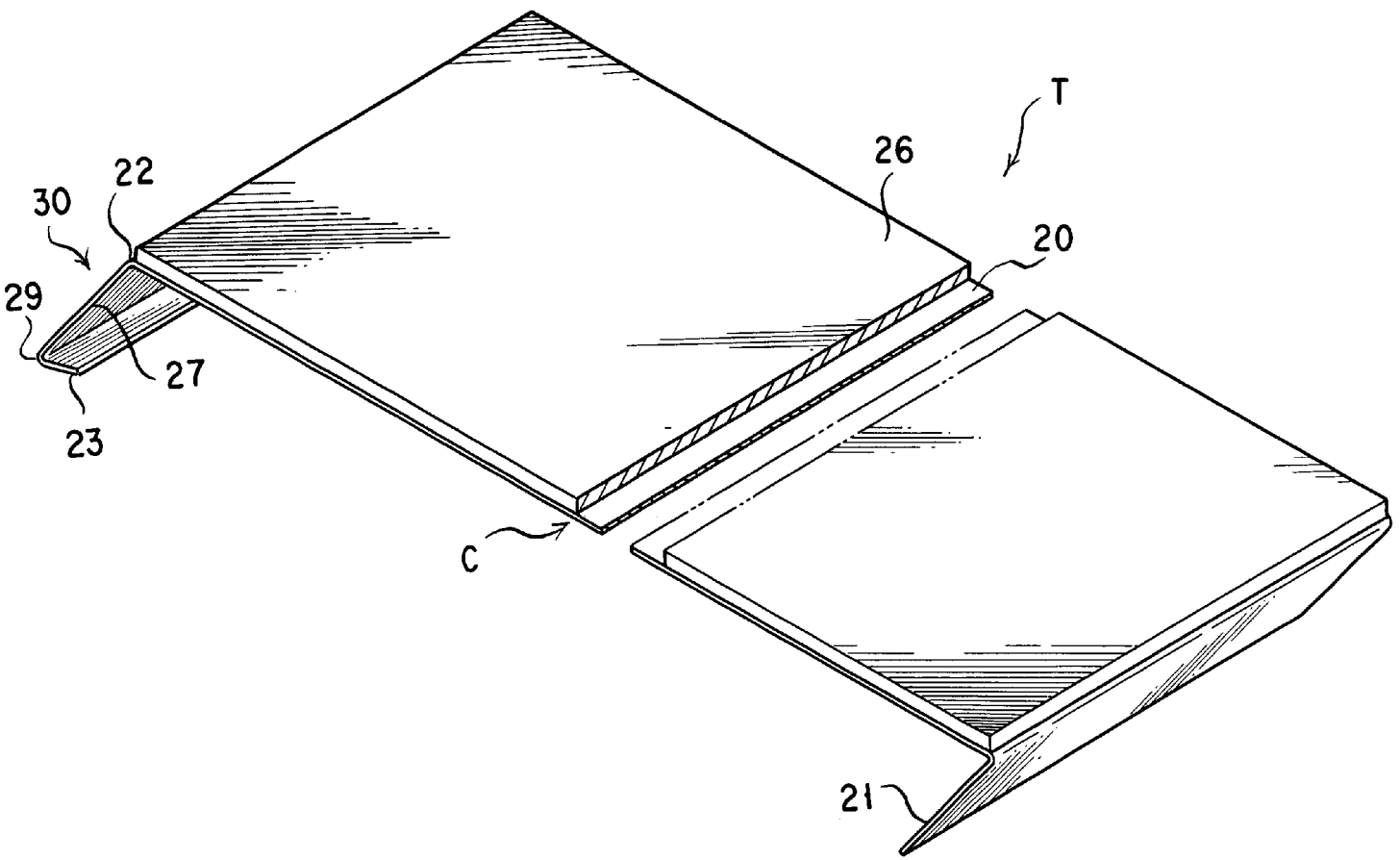
FIG. 3 is a perspective view, partly broken away for illustrative convenience, of the blanket assembly for use with the FIG. 1 blanket cylinder.

The capital B in both FIGS. 1 and 2 generally denotes a cylinder assembly having formed eccentrically therein an undercut groove 7 extending parallel to the cylinder axis. The undercut groove 7 has a relatively constricted entrance slot 6 cut in the surface of the cylinder assembly B. A blanket assembly T, shown by itself in FIG. 3, is to be mounted to the cylinder assembly B by having its pair of opposite ends engaged in the undercut groove 7 through the entrance slot 6.

Rotatably received in the undercut groove 7 is a blanket retainer spindle 12 for positively enagaging one end of the blanket assembly T. The retainer spindle 12 is spring biased to pull that end of the blanket assembly T deeper into the undercut groove 7 and hence to hold the blanket assembly tightly against the cylinder assembly B. At 13 are shown means for turning the retainer spindle 12 against the spring bias to loosen and dismount the blanket assembly T.

The noted blanket assembly T, cylinder assembly B, and blanket retainer spindle 12 will be discussed in more detail hereinbelow, in that order and under separate headings. How the blanket assembly T is mounted to, and dismounted from, the cylinder assembly B will be explained after the discussion of the listed major components.

Blanket Assembly

With reference to FIG. 3 the blanket assembly T is a combination of a blanket 26 of rubber or like material and a metal-made carrier sheet C therefor. The carrier sheet C has a major portion 20 to which the blanket 26 is bonded, a first end portion bent at an acute angle to the major portion 20 to provide a first flange 21, and a second end portion bent twofold at 22 and 29 to provide a second flange 27, which is at an obtuse angle to the major portion 20, and a rim 23 at an acute angle to the second flange 27.

A rectangular piece of sheet material, the blanket 26, and of course the major portion 20 of the carrier sheet C, have a longitudinal dimension approximately equal to the circumference of the cylinder assembly B minus the width of the entrance slot 6 of the undercut groove 7. As will be understood by referring back to FIG. 2, therefore, the blanket 26 is to be left wholly exposed on the surface of the cylinder assembly B when the blanket assembly T is mounted in position thereon.

It will also be observed from FIG. 2 that the first flange 21 of the carrier sheet C is at the upstream end of the blanket assembly T with respect to the predetermined rotational direction of the cylinder assembly B during printing, which is clockwise as indicated by the arrow in FIG. 2. At the downstream end, then, of the blanket assembly T are the rim 23 and the second flange 27 for engaging the retainer spindle 12 in the undercut groove 7. The angles of the flanges 21 and 27 relative to the major portion 20, and that of the rim 23 relative to the flange 27 will be later set forth in more detail in the course of the discussion of the undercut groove 7 in the cylinder assembly B and of the blanket retainer spindle 12 housed therein.

Cylinder Assembly

Referring back to FIG. 1, the cylinder assembly B comprises a body part 1 of cylindrical shape, and a pair of aligned shafts 2 and 3, complete with collars 4 and 5, coaxially attached, as by pressfitting, to the opposite ends of the body part 1. The undercut groove 7 is cut eccentrically in the body part 1, extending parallel to its axis, and open at both ends to a pair of holes 10 and 11 in the collars 4 and 5. The outer ends of the holes 10 and 11 are closed with bearing plates 14 and 15 rotatably supporting the retainer spindle 12.

As drawn on an enlarged scale in FIG. 2, the undercut groove 7 is approximately teardrop-shaped in cross section, having the entrance slot 6 of minimal width cut in the surface of the body part 1, and a pair of walls 8 and 9 diverging apart as they extend away from the entrance slot. The entrance slot 6 is only as wide as somewhat more than twice the thickness of the carrier sheet C of the blanket assembly T.

Also as seen cross-sectionally as in FIG. 2, the entrance slot 6 is bounded by and between a first 24 and a second 25 longitudinal edge, which are defined in turn by the surface of the cylinder assembly body part 1 and the diverging inside walls 8 and 9 of the undercut groove 7. The first longitudinal edge 24 is to be engaged by the upstream end flange 21 of the blanket assembly T and so formed into approximately the same acute angle as that between the upstream end flange 21 and major portion 20 of the blanket assembly carrier sheet C. The second longitudinal edge 25 is to be temporarily engaged by the downstream end rim 23 of the blanket assembly T during the mounting of the blanket assembly to the cylinder assembly B. The angle of this second longitudinal edge 25 is more acute than the angle between the rim 23 and downstream end flange 27 of the blanket assembly T.

A study of FIG. 2 will further indicate the relative angles of the flanges 21 and 27 of the blanket assembly T with respect to its major portion 20. These angles should be so determined that when both flanges 21 and 27 are fully received in the undercut groove 7 as in this figure, or when the downstream end flange 27 is being inserted in the undercut groove following the insertion of the downstream end rim 23 (FIG. 4D), both flanges 21 and 27 are in parallel spaced relationship to each other or somewhat diverge apart from each other as they extend away from the entrance slot 6.

Blanket Retainer Spindle

As seen in both FIGS. 1 and 2, the retainer spindle 12 of generally cylindrical shape is rotatably received with clearance in the undercut groove 7 in the cylinder assembly body part 1. Further the retainer spindle 12 has a pair of reduced diameter extensions at its opposite ends, which are received with substantial clearance in the pair of aligned holes 10 and 11 in the collars 4 and 5, a pair of journals 40 of still more reduced diameter rotatably supported by the noted pair of bearing plates 14 and 15, and a pair of extensions 41 of hexagonal cross section projecting outwardly of the cylinder assembly B.

Coiled around the reduced diameter extensions of the retainer spindle 12 are a pair of helical torsion springs 17 and 18 anchored each at one end to the retainer spindle 12 and at the other end to one of the bearing plates 14 and 15. The torsion springs 17 and 18 conjointly bias the retainer spindle 12 to turn counterclockwise, as viewed in FIG. 2, this being a direction necessary for holding the blanket assembly T firmly against the cylinder assembly B.

The pair of hexagonal extensions 41 projecting from the cylinder assembly B is for engagement by a spanner or wrench 19 in turning the retainer spindle 12 clockwise, again as viewed in FIG. 2, against the forces of the torsion springs 17 and 18. With the retainer spindle 12 so turned, the blanket assembly T is loosenable and dismountable from the cylinder assembly B. The turning tool 19 in combination with the hexagonal extensions 41 of the retainer spindle 12 constitute the dismounting means 13.

FIG. 2 best reveals that the retainer spindle 12 is recessed longitudinally to provide a pull-in hook 16 and a push-out ledge 28 which are spaced from, and opposed to, each other circumferentially of the retainer spindle. The pull-in hook 16 is to engage the rim 23 at the downstream end of the blanket assembly T for tightening the same around the cylinder assembly B with the clockwise rotation of the retainer spindle 12. It will be noted from this figure that the pull-in hook 16 is more acutely angled than the rim 23 is to the flange 27. The push-out ledge 28 is for movement, upon counterclockwise rotation of the retainer spndle 12 from its FIG. 2 position, into abutment against the rim 23 for pushing the same back toward the entrance slot 6 in dismounting the blanket assembly T.

The pull-in hook 16 and push-out ledge 28 should therefore be sufficiently spaced from each other not to interfere with each other's functioning. As will be understood, the hook 16 and ledge 28 need not be formed continuously throughout the length of the retainer spindle 12 but may be broken up into several discrete parts spaced longitudinally of the spindle.

Method of Blanket Mounting

The blanket assembly T may be mounted to the cylinder assembly B through the procedure of FIGS. 4A–4E. The mounting procedure starts with the full insertion, as in FIG. 4A, of the upstream end flange 21 of the blanket assembly T in the undercut groove 7 in the cylinder assembly body part 1, resulting in the positive engagement of this upstream end flange with the first longitudinal edge 24 of the undercut groove entrance slot 6.

Figure 4A:
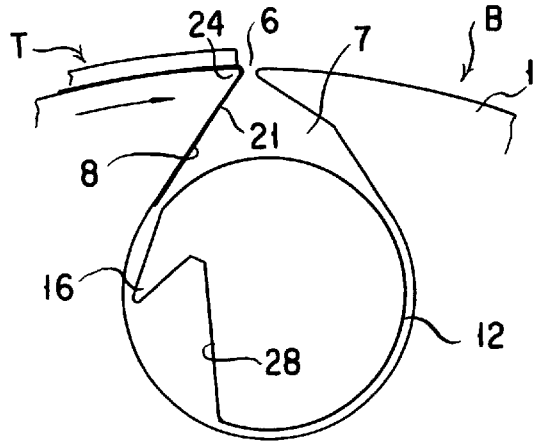
FIGS. 4A through 4E are a series of diagrammatic cross-sectional views somewhat similar to FIG. 2 but explanatory of the FIG. 3 blanket assembly is mounted to the FIG. 1 blanket cylinder.

FIG. 4A is also explanatory of the angular position of the retainer spindle 12 when the pair of torsion springs 17 and 18, FIG. 1, are not torsionally stressed. The retainer spindle 12 is now fully turned counterclockwise, with the pull-in hook 16 held spaced in that direction from the tip of the upstream end flange 21, as fully inserted in the undercut groove 7, of the blanket assembly T.

Figure 4B:
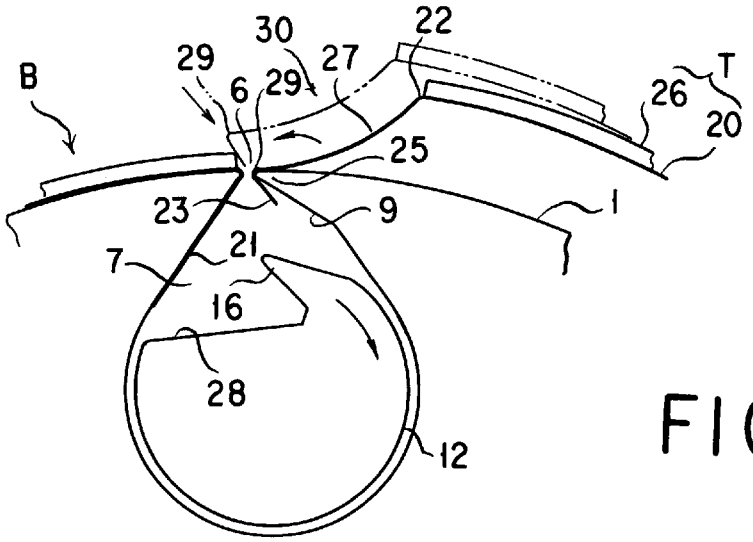

Then, following the full insertion of the upstream end flange 21 of the blanket assembly T in the undercut groove 7, the cylinder assembly B may be turned one complete revolution in a clockwise direction from its FIG. 4A position to that of FIG. 4B. The blanket assembly T will be wrapped around the cylinder assembly B upon complete revolution of the latter, with the downstream end portion 30 of the blanket assembly brought close to the undercut groove entrance slot 6.

Then the retainer spindle 12 may be turned clockwise from its FIG. 4A position to that of FIG. 4B, by means of the wrench 19, FIG. 1, thereby stressing the pair of torsion springs 17 and 18. The pull-in hook 16 of the retainer spindle 12 is now positioned some distance away from the upstream end flange 21 of the blanket assembly T received in the undercut groove 7. The retainer spindle 12 may be temporarily locked in this FIG. 4B position by any appropriate locking means, not shown, against the forces of the torsion springs 17 and 18.

Then the rim 23 of the blanket assembly T may be engaged with the second longitudinal edge 25 of the undercut groove entrance slot 6. Toward this end the downstream end portion 30 of the blanket assembly may be first positioned as indicated by the broken lines in FIG. 4B and, by applying a force thereto in such a direction as to cause the flange 27 to buckle toward the cylinder assembly B, driven into the entrance slot 6, as indicated by the solid lines in the same figure. Despite the narrowness of the entrance slot 6, the rim 23 will relatively easily enter therein thanks to the greater angle between the rim and the downstream end flange 27 of the blanket assembly T than the angle of the second longitudinal edge 25 of the entrance slot.

Figure 4C:
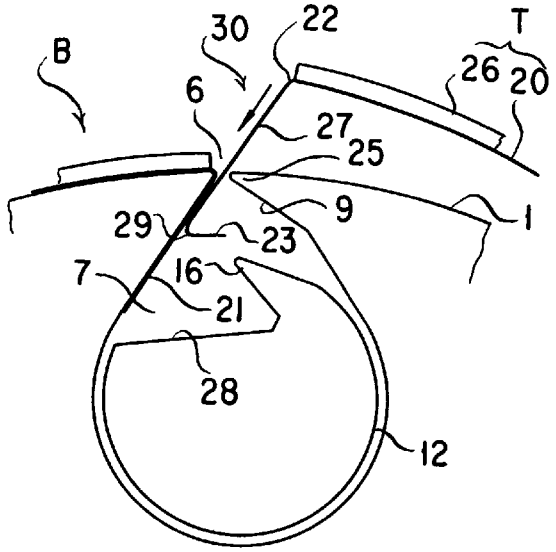

Then, preparatory to insertion of the downstream end flange 27 in the undercut groove 7, the buckling of the flange may be removed by turning the same about the entrance slot edge 25 in a counterclockwise direction, as indicated by the arrow in FIG. 4B. Then the downstream end flange 27 may be pushed linearly into the undercut groove 7, as depicted in FIG. 4C, until the flange is received therein as far down as possible as in FIG. 4D. Now the blanket carrier major portion 20 may, or may not, be in contact with the surface of the cylinder assembly body part 1. The downstream end flange 27 will be admitted into the undercut groove 7 without frictional engagement with the upstream end flange 21 because they are so angled to the carrier sheet major portion 20 that, when both received in the undercut groove, they are parallel to each other or diverge apart as they exend away from the entrance slot 6.

Figure 4D:
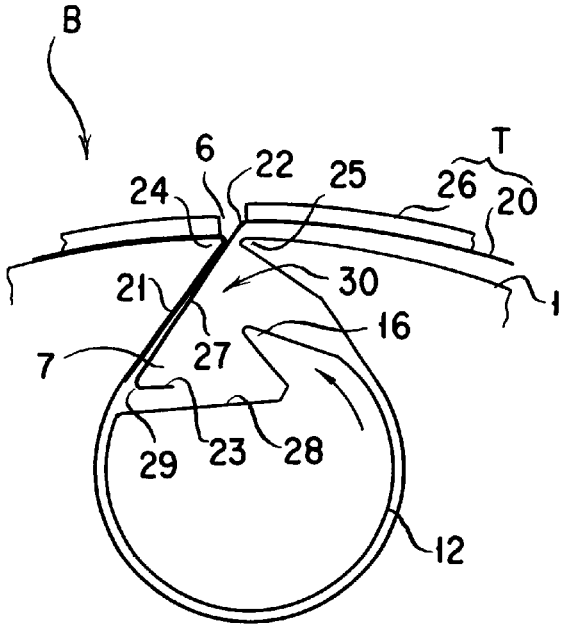
Figure 4E:
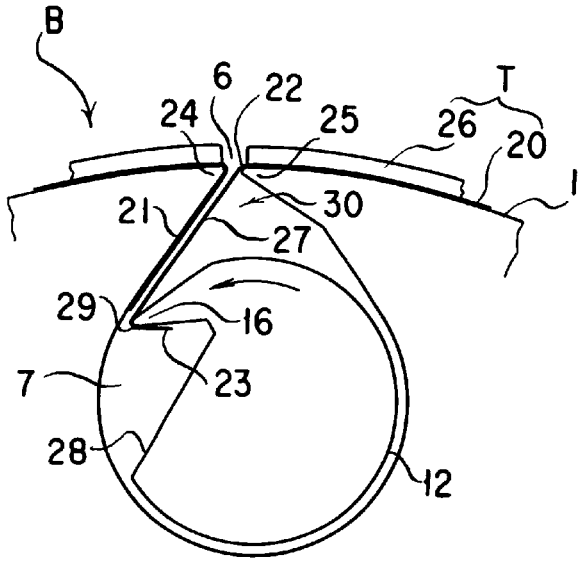

Then the retainer spindle 12 may be unlocked and allowed to turn counterclockwise from its FIG. 4D position to its FIG. 4E position under the bias of the torsion springs 17 and 18. In the course of this counterclockwise turn the retainer spindle 12 will positively engage the rim 23 of the blanket assembly T by its pull-in hook 16 and so subsequently pull its downstream end flange 27 deeper into the undercut groove 7. As is apparent from a comparison of FIGS. 4A and 4E, the retainer spindle 12 will be held sprung counterclockwise even after the flange 27 has been fully received in the undercut groove 7, holding in turn the blanket assembly T firmly wrapped around the cylinder assembly against the likelihood of slacking during printing.

Method of Blanket Dismounting

Figure 5A:
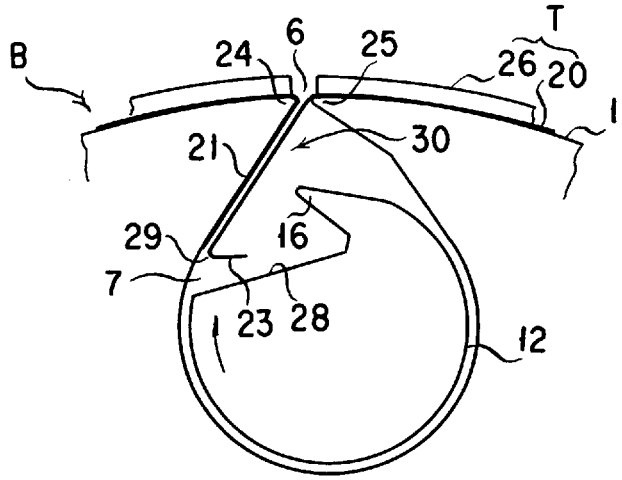
FIGS. 5A through 5C are a series of diagrammatic cross-sectional views similar to FIGS. 4A–4E but explanatory of how the blanket assembly is dismounted from the blanket cylinder.

The blanket assembly T to be dismounted being in the state of FIG. 4E, the retainer spindle 12 may be wrenched clockwise from this position against the forces of the torsion springs 17 and 18. So turned, the retainer spindle 12 will disengage the blanket assembly rim 23 from its pull-in hook 16, as shown in FIG. 5A.

Figure 5B:
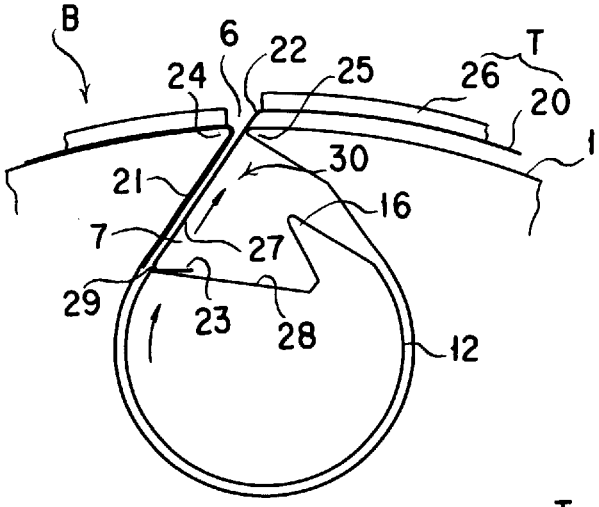

Then, as pictured in FIG. 5B, the push-out ledge 28 of the retainer spindle 12 will come into abutment against the blanket assembly rim 23 and, with the continued clockwise turn of the retainer spindle, push the rim toward the undercut groove entrance slot 6. Thus will the blanket assembly T come loose on the cylinder assembly B.

Figure 5C:
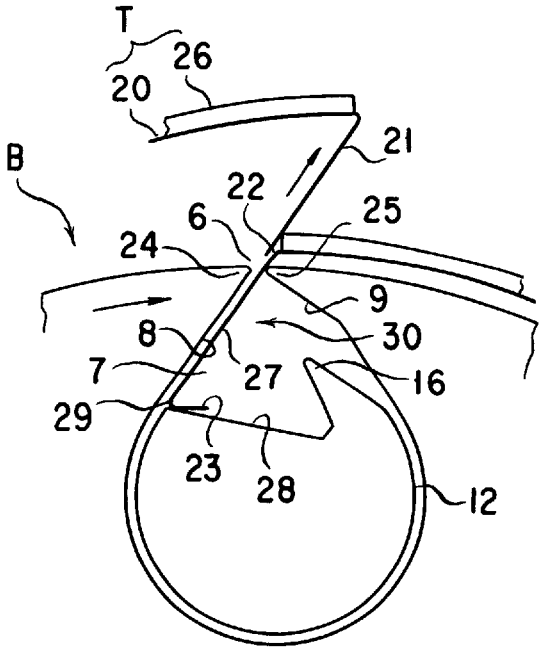

Then, with the blanket assembly T sufficiently loosened on the cylinder assembly B, the blanket assembly upstream end flange 21 may be manually withdrawn from the undercut groove 7, as depicted in FIG. 5C. Then the blanket assembly may be unwrapped from the cylinder assembly by turning the later clockwise. Finally, the blanket assembly downstream end portion 30 may be withdrawn from the undercut groove through the reversal of the mounting procedure set forth in conjunction with FIGS. 4B and 4C.

Various departures from the exemplified blanket cylinder according to the present invention may be made in the practice of the invention in order to conform to design preferences or to the requirements of each specific application of the invention. For example, two or more undercut grooves, each with a retainer spindle mounted therein, may be formed at circumferential spacings on the blanket cylinder within the scope of the invention. It is therefore appropriate that the invention be construed broadly and in a manner consistent with the fair meaning or proper scope of the claims which follow.

What is claimed is:

1. A blanket cylinder for use in offset lithography with a blanket assembly including a blanket and a carrier sheet therefor, the carrier sheet of the blanket assembly having a major portion to which the blanket is attached, a first end portion bent at an angle to the major portion to provide a first flange, and a second end portion bent twofold to provide a second flange at an angle to the major portion, and a rim at an angle to the second flange, the blanket cylinder comprising:

(a) a cylinder body having formed therein an undercut groove extending parallel to an axis of the cylinder body to define a first undercut longitudinal edge and a second undercut longitudinal edge, the undercut groove having an entrance slot bounded by and between the first undercut longitudinal edge which is cross-sectionally shaped to be engaged by the first flange of the carrier sheet, and the second undercut longitudinal edge which is cross-sectionally shaped to be temporarily engaged by the rim of the carrier sheet preparatory to insertion of the second flange thereof into the undercut groove;

(b) a retainer spindle received in the undercut groove in the cylinder body for bidirectional rotation therein, the retainer spindle being cross-sectionally shaped to include a pull-in hook for engaging the rim of the carrier sheet of the blanket means in order to pull the second end portion thereof into the undercut groove with the rotation of the retainer spindle in a first direction, and a push-out ledge, circumferentially spaced from and opposed to the pull-in hook, for abutment against the rim of the carrier sheet in order to push the second end portion thereof out the undercut groove with the rotation of the retainer spindle in a second direction which is opposite to the first direction; and (c) resilient means acting between the retainer spindle and the cylinder body for energizing the retainer spindle in the first direction.

2. The blanket cylinder of claim 1 wherein the undercut groove in the cylinder is approximately teardrop-shaped in cross section, with the first undercut longitudinal edge of the entrance slot acute-angled in cross section in order to be positively engaged by the first flange of the carrier sheet of the blanket means.

3. The blanket cylinder of claim 2 wherein the second undercut longitudinal edge of the entrance slot is acute-angled in cross section in order to be positively engaged by the rim of the carrier sheet of the blanket means.

4. The blanket cylinder of claim 3 wherein the second undercut longitudinal edge of the entrance slot is more acutely angled than the first undercut longitudinal edge of the entrance slot.

5. The blanket cylinder of claim 1 wherein the resilient means comprises torsion spring means acting directly on the retainer spindle.

6. The blanket cylinder of claim 1 wherein the retainer spindle has at least one end projecting from the cylinder and adapted to be turned in the second direction against the force of the resilient means by a hand tool.

7. The blanket cylinder of claim 1 wherein, when the resilient means energizes the retainer spindle in the first direction, the blanket assembly is held fast against the cylinder body.

8. In a rotary offset printing press, in combination:

(A) blanket means comprising:

(a) a blanket; and (b) a carrier sheet having a major portion to which the blanket is attached, a first end portion bent at an acute angle to the major portion to provide a first flange, and a second end portion bent twofold to provide a second flange at an obtuse angle to the major portion, and a rim at an acute angle to the second flange;

(B) a blanket cylinder comprising:

(a) a cylinder having formed therein an undercut groove of approximately teardrop-shaped cross section extending parallel to the axis of the cylinder, the undercut groove having an entrance slot bounded by and between a first longitudinal edge which is cross-sectionally shaped into an acute angle to be engaged by the first flange of the carrier sheet of the blanket means, and a second longitudinal edge which is cross-sectionally shaped into an acute angle to be temporarily engaged by the rim of the carrier sheet preparatory to insertion of the second flange thereof into the undercut groove;

(b) a retainer spindle received in the undercut groove in the cylinder for bidirectional rotation therein, the retainer spindle being cross-sectionally shaped to include a pull-in hook for engaging the rim of the carrier sheet in order to pull the second end portion thereof into the undercut groove with the rotation of the retainer spindle in a first direction, and a push-out ledge for abutment against the rim of the carrier sheet in order to push the second end portion thereof out the undercut groove with the rotation of the retainer spindle in a second direction which is opposite to the first direction; and (c) resilient means for energizing the retainer spindle in the first direction in order to hold the blanket means fast against the cylinder.

9. The invention of claim 8 wherein the second longitudinal edge of the entrance slot of the undercut groove is cross-sectionally shaped into an acute angle that is less than the acute angle between the rim and the second flange of the carrier sheet of the blanket means.

10. The invention of claim 8 wherein the first longitudinal edge of the entrance slot of the undercut groove is cross-sectionally shaped into approximately the same acute angle as that between the first flange and the major portion of the carrier sheet of the blanket means.

* * * * *